US007367732B2

(12) United States Patent
Koga et al.

(10) Patent No.: US 7,367,732 B2
(45) Date of Patent: May 6, 2008

(54) METHOD AND APPARATUS FOR CONTROLLING THE SHEET FEEDING SPEED IN A PRINTER

(75) Inventors: Yuji Koga, Nagoya (JP); Shohei Koide, Nagoya (JP); Tetsuya Ouchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 68 days.

(21) Appl. No.: 11/236,661

(22) Filed: Sep. 28, 2005

(65) Prior Publication Data

US 2006/0067777 A1 Mar. 30, 2006

(30) Foreign Application Priority Data

Sep. 29, 2004 (JP) ..... 2004-283310

(51) Int. Cl.
*B65H 7/02* (2006.01)

(52) U.S. Cl. ..... 400/624; 347/16; 347/104; 271/265.01; 399/45

(58) Field of Classification Search ..... 400/624, 400/76, 120.09; 347/104, 16, 8; 271/9.02, 271/265.01, 242
See application file for complete search history.

(56) References Cited

U.S. PATENT DOCUMENTS 5,104,110 A * 4/1992 Haibara ..... 271/9.02
5,469,197 A * 11/1995 Hiramatsu ..... 347/16
5,649,276 A * 7/1997 Quesnel et al. ..... 399/390
6,304,731 B1 * 10/2001 Able et al. ..... 399/45
6,341,905 B1 1/2002 Suzuki ..... 400/120.09
6,412,902 B2 * 7/2002 Matsumoto et al. ..... 347/19
6,866,358 B2 * 3/2005 Masuyama et al. ..... 347/14

FOREIGN PATENT DOCUMENTS

JP 10254202 9/1998

* cited by examiner

*Primary Examiner*—Jill E. Culler
(74) *Attorney, Agent, or Firm*—Banner & Witcoff, Ltd.

(57) ABSTRACT

In order to adjust a position of a cut sheet when the cut sheet begins to be sent to a printing positions a leading edge of the cut sheet is fed towards a pair of sending rollers for sending the cut sheet to a printing position, wherein the sending rollers are held at rest or rotated in reverse. If a predetermined condition is satisfied, a feeding speed of the cut sheet decreases when the leading edge of the cut sheet reaches a position that is a predetermined distance upstream of the sending rollers. If the predetermined condition is not satisfied, the feeding speed of the cut sheet does not decrease before the leading edge of the cut sheet contacts the sending roller. A decline in printing quality and an unnecessary delay in printing time can be prevented. With the sending rollers, an effect to prevent the leading edge of the cut sheet from being fed in a slanted position is also maintained.

16 Claims, 8 Drawing Sheets

(a)

(b)

| Feeding Speed(ips) | 1 | 3 | 4.5 | 8 |
|---|---|---|---|---|
| Area of Peeled Portion($mm^2$) | 0.575 | 1.798 | 2.0335 | 4.325 |

METHOD AND APPARATUS FOR CONTROLLING THE SHEET FEEDING SPEED IN A PRINTER

CROSS-REFERENCE TO RELATED APPLICATION

This application claims priority to Japanese Patent Application No. 2004-283310 filed on Sep. 29, 2004, the contents of which are hereby incorporated by reference into the present application.

BACKGROUND OF THE INVENTION

1. Field of the Invention

The present invention relates to a printer that separates a single cut sheet from a stack of cut sheets, feeds the separated sheet and prints on the cut sheet. A printer of the present invention provides a printing head to print on the cut sheet at a printing position and a pair of sending rollers to send the cut sheet to the printing position. The printer of the present invention can control the position of the cut sheet when the cut sheet begins to be sent to the printing position, and can control a relationship between the timing of when to begin sending the cut sheet to the printing position and the timing of when to have the printing head begin a printing operation. According to the printer of the present invention, a relationship between a print start position on the cut sheet and a leading edge of the cut sheet can be adjusted to a desired relationship, and printing can be performed on a desired location of the cut sheet. Printing can also be performed without leaving a margin along the leading edge of the cut sheet.

The present invention also relates to a method of controlling a printer for adjusting a position of a cut sheet to a desired position when the cut sheet begins to be sent towards a printing position.

The printer of the present invention is not limited to a printing machine exclusively for printing, such as an inkjet printer or a laser printer. The printer of the present invention may be built into a copy machine, a fax machine, or a multifunctional machine, and includes a mechanism within these machines to print pictures and/or characters on the cut sheet.

2. Description of the Related Art

A printer that pulls out a single cut sheet from a stack of cut sheets, feeds the pulled out cut sheet, sends the fed cut sheet to a printing position and prints on the cut sheet at the printing position is known. This type of printer provides a feeder to pull out the single cut sheet from the stack of cut sheets and feed the cut sheet, a pair of sending rollers to send the cut sheet fed from the feeder towards the printing position, and a printing bead to print on the cut sheet sent to the printing position by the sending rollers.

An art for controlling the position of the cut sheet when the cut sheet begins to be sent to the printing position is known, wherein the art stops or reverses a rotating direction of the pair of sending rollers, which sends the cut sheet to the printing position, and feeds the cut sheet to that pair of sending rollers. When the cut sheet is fed towards the stationary or reverse-rotating sending rollers, a leading edge of the cut sheet becomes positioned in a predetermined position where the sending rollers contact. The leading edge of the cut sheet is aligned along a contacting line between the sending rollers. When the pair of sending rollers begins to rotate in the standard direction, the cut sheet with the leading edge positioned in the predetermined position begins to be sent to the printing position at a desired timing. According to this art, a position of the cut sheet when the cut sheet begins to be sent to the printing position can be controlled to a fixed position, and a position of the cut sheet when a printing operation begins with the printing head can be controlled to a desired position. According to this type of printer, a relationship between a print start position on the cut sheet and the leading edge of the cut sheet can be adjusted to a desired relationship, and printing can be performed on a desired location of the cut sheet. Printing can also be performed without leaving a margin along the leading edge of the cut sheet when a margin-less printing mode is desired.

This type of printer is described in Japanese Laid-Open Patent Application Publication No. 1998-254202. This printer provides an image creation mechanism to create a transferable printing image and a transfer printing mechanism (corresponds to the printing head of the present invention) to transfer the transferable printing image produced by the image creation mechanism to the cut sheet. This printer further provides a feeder to pull out a single cut sheet from a stack of cut sheets and feed the pulled out cut sheet, a pair of sending rollers to send the cut sheet fed from the feeder to a printing position (in this case a transfer printing position), and a sensor positioned on an upstream side of that sending rollers. The sensor detects a timing that the leading edge of the cut sheet, fed towards the sending roller from the feeder, reaches a position to face the sensor.

This printer begins reducing the feeding speed of the feeder at a timing when the leading edge of the cut sheet is detected by the sensor, and decelerates to a feeding speed of zero after a predetermined period. The decelerating pattern is designed so that the following phenomenon occurs. That is, after the leading edge of the cut sheet has been positioned upon contacting the sending rollers, the feeder feeds the cut sheet further and the feeding operation is stopped before the cut sheet is substantially curved. If the cut sheet is substantially curved, it generates noise because the curved cut sheet hits a guide board that guides the cut sheet. The printer described in Japanese Laid-Open Patent Application Publication No. 1998-254202 prevents the noise from generating by beginning the deceleration of the feeding speed of the cut sheet before the leading edge of the cut sheet contacts the sending rollers.

The printer described in Japanese Laid-Open Patent Application Publication No. 1998-254202 switches the time it takes, depending on the size of the cut sheet, for the feeding speed to become zero once it begins to decelerate. The tendency to curve varies depending on the size of the cut sheet, and when the deceleration pattern is switched according to the site of the cut sheet, the noise generated by the cut sheet hitting the guide board can be contained within a predetermined level, even if the size of the cut sheet varies.

BRIEF SUMMARY OF THE INVENTION

Depending on the type of the cut sheet, sometimes it is not necessary to reduce the feeding speed at a time when the leading edge of the cut sheet contacts the sending rollers. Alternatively, depending on the type of printing mode, it is not necessary to reduce the feeding speed at a time when the leading edge of the cut sheet contacts the sending rollers.

However, the printer described in Japanese Laid-Open Patent Application Publication No. 1998-254202 does not consider differences among various types of cut sheets. Further, it does not consider differences among various types of printing modes. Before the leading edge of the cut sheet contacts the sending rollers, the feeding speed of the cut sheet is always reduced regardless of the type of the cut sheet or the type of the printing mode.

If the feeding speed of the cut sheet is reduced before the leading edge of the cut sheet contacts the sending rollers, the time required for printing becomes longer. The printer in Japanese Laid-Open Patent Application Publication No. 1998-254202 unnecessarily lengthens the time required to print in a case where there is no need to reduce the feeding speed.

Based on research by the inventors of the present invention, it has been found that the capability to adjust a cut sheet to a fixed position decreases if the feeding speed of when the leading edge of the cut sheet contacts the sending rollers is reduced. While a single cut sheet is pulled out from a stack of cut sheets and fed toward a pair of sending rollers, there are occasions when the position of the cut sheet is out of alignment. If this is the case, the leading edge of the cut sheet does not become parallel with the pair of sending rollers, and becomes slanted with respect to the sending rollers. If the feeding speed is high when the leading edge of the cut sheet contacts the sending rollers, the leading edge of the cut sheet is adjusted to become parallel with the sending rollers. In contrast, if the feeding speed is low when the leading edge of the cut sheet contacts the sending rollers, the leading edge of the cut sheet cannot be adjusted to become parallel with the sending rollers. Hereinafter, this phenomenon will be referred to as a slant-adjusting phenomenon. Based on research by the inventors of the present invention, it has been found that when the feeding speed is reduced in a case where deceleration is unnecessary, the slant-adjusting phenomenon could not be obtained when needed.

The present invention was completed based on the circumstances described above, and a printer is realized wherein a feeding speed of a cut sheet before a leading edge of the cut sheet contacts a pair of sending rollers decelerates when necessary, but does not decelerate when unnecessary.

In terms of depending on certain conditions to switch a feeding speed to decelerate or not, a printer of the present invention differs-with the art- described in Japanese-Laid-Open Patent Application Publication No. 1998-254202, which always decelerates the feeding speed regardless of conditions.

Based on research by the inventors of the present invention, it has been determined that there are cases when reducing the feeding speed of the cut sheet is necessary and cases when reducing the feeding speed of the cut sheet is unnecessary. Depending on the type of cut sheet, there are occasions when the forcefully fed cut sheet is damaged by the sending rollers unless the feeding speed is decreased before the leading edge of the cut sheet contacts the sending rollers. Depending on the type of cut sheet, there are occasions when the cut sheet is not damaged even if the leading edge of the cut sheet forcefully hits the sending rollers. Depending on the printing mode, there are occasions when printing quality severely declines due to damage on the leading edge of the cut sheet, whereas there are also occasions when the decline in printing quality is tolerated even if the leading edge of the cut sheet is somewhat damaged.

The printer of the present invention reduces a feeding speed before a leading edge of a cut sheet contacts a pair of sending rollers for occasions when problems will arise unless it decelerates, and does not reduce the feeding speed for occasions when problems will not arise even if it does not decelerate. It does not unnecessarily lengthen the time required to print due to decelerating even when unnecessary. Alternatively, in other cases, a slant-adjusting phenomenon can be obtained when necessary.

The printer of the present invention provides a feeder to feed a cut sheet from a stack of cut sheets, a pair of sending rollers to send the cut sheet fed from the feeder to a printing position, a printing head to print on the cut sheet at the printing position, a sensor disposed between the feeder and the sending rollers to detect a leading edge of the cut sheet fed towards the sending rollers, and a speed controller of the feeder to reduce a feeding speed of the feeder at a point in time determined from a point in time when the sensor detects the leading edge of the cut sheet, wherein the reducing operation of the feeding speed is performed when a predetermined condition is satisfied.

The point in time when the feeder reduces the feeding speed is determined from the point in time when the sensor detects the leading edge of the cut sheet. In other words, the feeding speed may be reduced at the point in time when the sensor detects the leading edge of the cut sheet. The feeding speed may be reduced at a point in time after a predetermined time period has elapsed from the point in time when the sensor detected the leading edge of the cut sheet. Alternatively, in other cases, the feeding speed may be reduced at a point in time after the cut sheet has been fed for a predetermined distance measured from when the point in time the sensor detected the leading edge of the cut sheet. What is significant is that the point in time in which the feeding speed will be reduced is determined from the point in time the sensor detects the leading edge of the cut sheet.

According to this printer, when the predetermined condition is satisfied, a high-quality printing image can be obtained because the leading edge of the cut sheet contacts the sending rollers in a situation where the speed has been reduced to a point in which the leading edge of the cut sheet does not get damaged by the sending rollers. On the other hand, when the predetermined condition is not satisfied, it does not unnecessarily lengthen the time required to print because the feeding speed of the cut sheet is not reduced. There are no cases wherein the slant-adjustment phenomenon cannot be obtained when the slant-adjustment phenomenon is necessary.

The present invention also relates to a method of controlling a printer providing a feeder to feed a cut sheet from a stack of cut sheets, a pair of sending rollers to send the cut sheet fed from the feeder to a printing position, and a printing head to print on the cut sheet at the printing position.

This controlling method provides a step of identifying a timing when the leading edge of the cut sheet is fed to a predetermined position upstream of the sending rollers for a predetermined distance and, when a predetermined condition is satisfied, a step of reducing the speed of the feeder at a timing identified by the above identifying step.

The predetermined position where the feeding speed of the feeder is reduced may be a position where the sensor to detect the leading edge of the cut sheet is disposed, and it may be a position downstream for a predetermined distance from the sensor.

According to this printer, when the predetermined condition is satisfied, a high-quality printing image can be obtained because the leading edge of the cut sheet contacts the sending rollers in a situation where the speed has been reduced to a point in which the leading edge of the cut sheet does not get damaged by the sending rollers.

BRIEF DESCRIPTION OF THE DRAWINGS

FIG. 6(*b*) shows a cross-sectional diagram emphasizing the construction of the sending roller.

FIG. 7(*b*) shows a table showing a relationship between the feeding speed when the leading edge of the cut sheet contacts the pair of sending rollers and the area where peeling has occurred on the leading edge of the cut sheet.

DETAILED DESCRIPTION OF THE INVENTION

A multifunctional device incorporating a printer practicing the present invention will be explained with reference to the figures.

Figure 1:
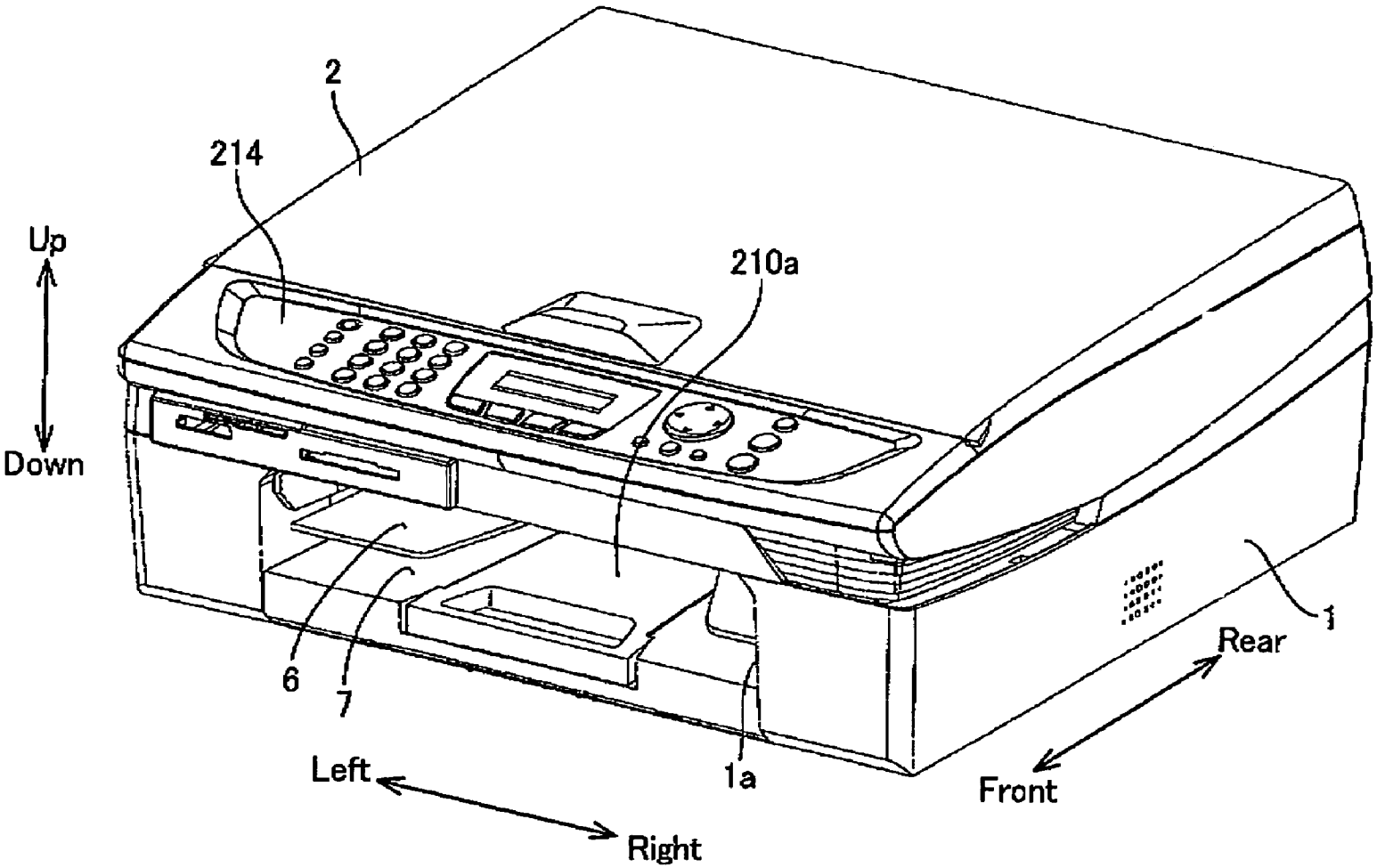
FIG. 1 shows an external perspective diagram of a multifunctional device with an embedded printer of an embodiment of the invention.
Figure 3:
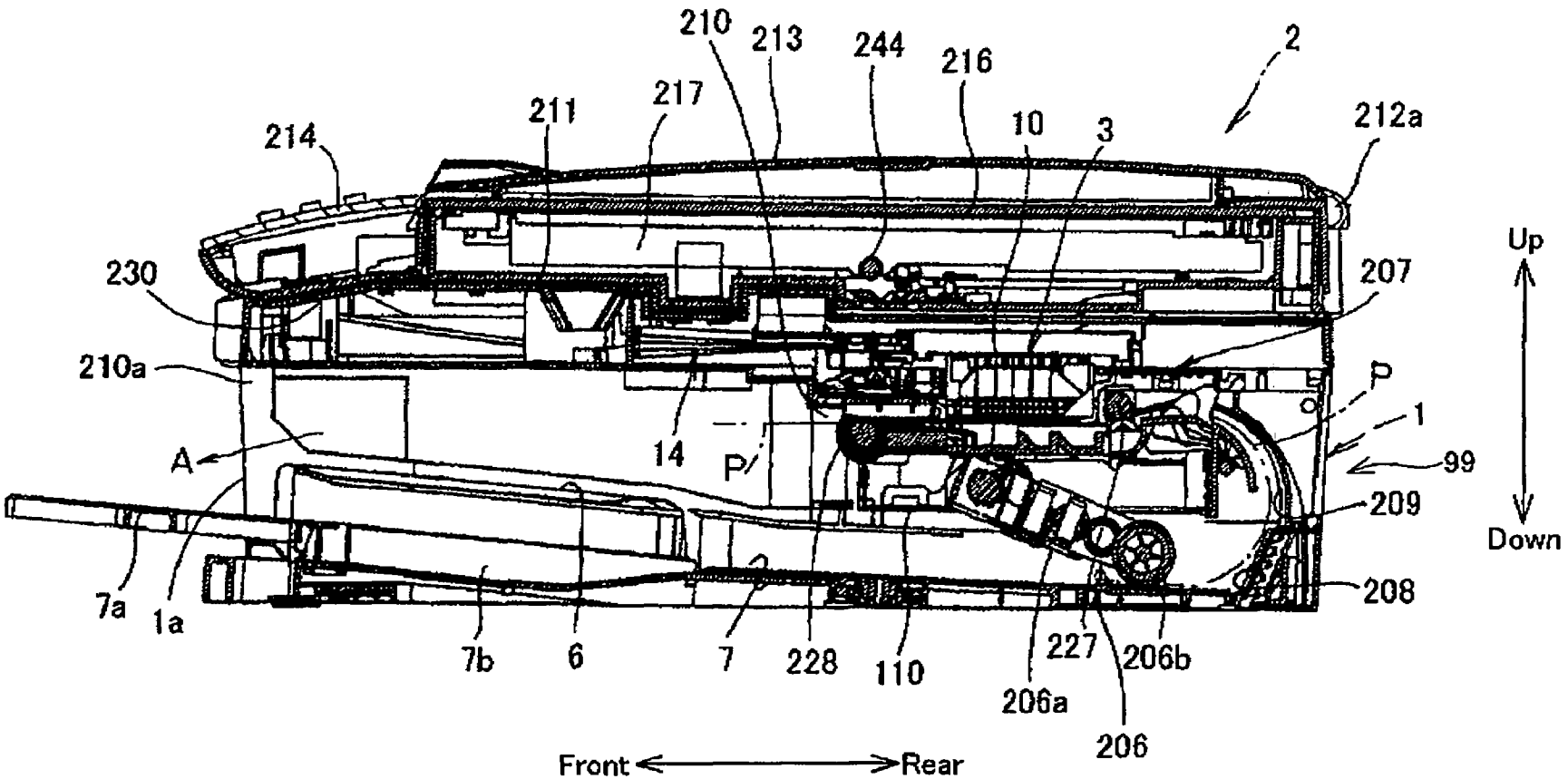
FIG. 3 shows a cross-sectional diagram in which the multifunctional device has been sliced approximately at the center from a right-left position.

The multifunctional device (abbreviated as MFD hereinafter) of the present embodiment provides a printing function, copying function, scanning function, and facsimile function. As shown in FIG. 1 and FIG. 3, image reading device 2 for the copying function or the scanning function is set up on an upper surface of main body frame 1 made of plastic injection molding item. Internally of the MFD, printer 99 is incorporated in a position below image reading device 2.

Figure 2:
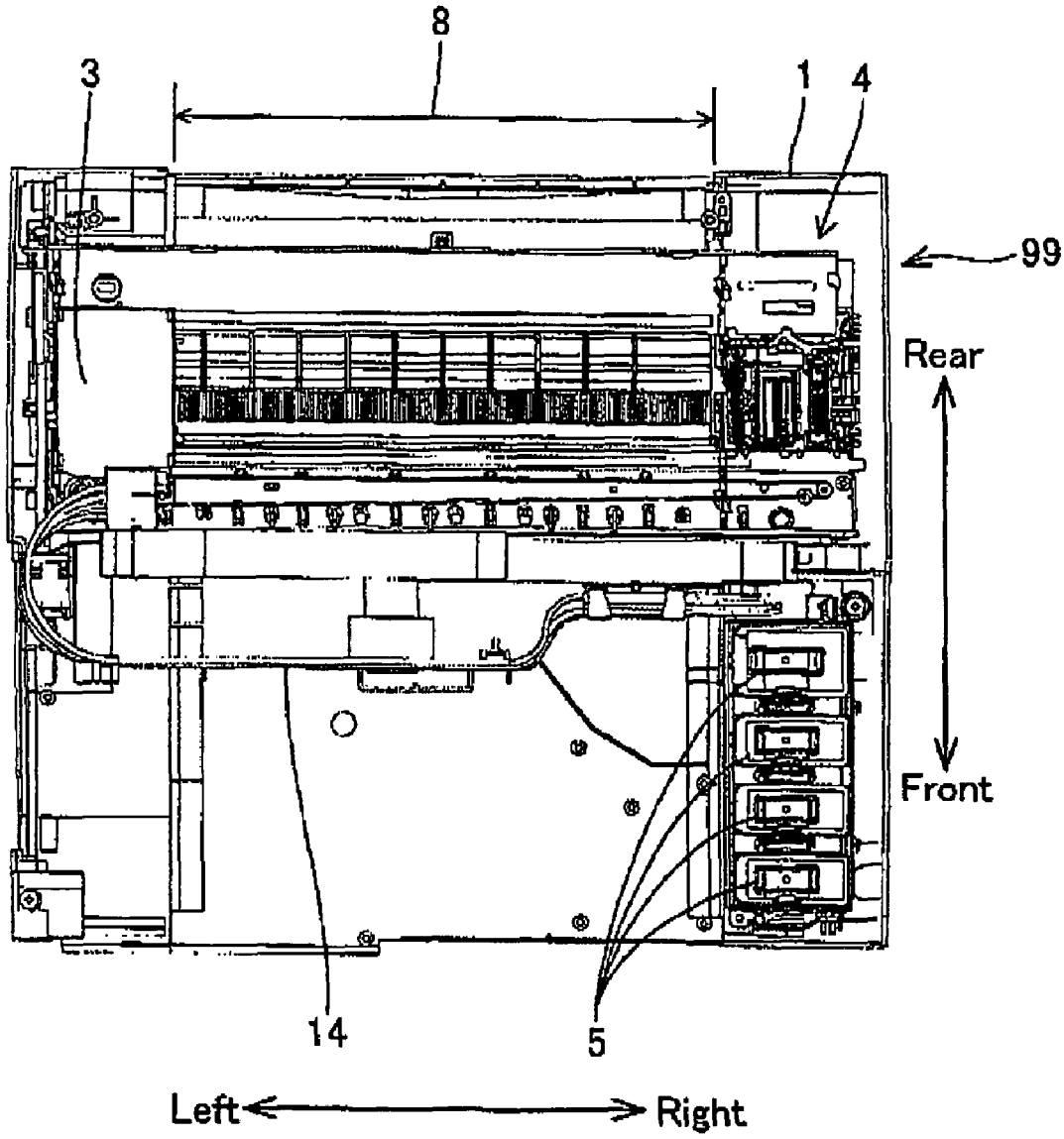
FIG. 2 shows a planar diagram illustrating the entire configuration of an internal mechanism of the multifunctional device.

As shown in FIG. 2 and FIG. 3, printer 99 provides carriage 3, movable in a round-trip fashion in a right-left direction. As shown in FIG. 3, printing head 10, which prints images or characters, is fixed on carriage 3. As shown in FIG. 2, printer 99 provides maintenance unit 4, and maintenance unit 4 recovers the clogging of nozzles of printing head 10. Ink tank 5 to supply ink to printing head 10 is also set up on printer 99.

Printer 99 prints on cut sheet P. Cut sheet P represents a sheet cut to a predetermined size, and it can be regular paper, glossy paper, coating paper exclusively for inkjet printers, or plastic film for OHP.

Paper-supplying cassette 7 is insertable in opening section 1*a* of a front surface of main body frame 1. Discharging tray 6 is disposed on an upper surface of paper-supplying cassette 7. Any cut sheet P selected from regular paper, glossy paper, coating paper, or plastic film can be stored in paper-supplying cassette 7.

As shown in FIG. 2, the long region extending from the vicinity of a left end to the vicinity of a right end of a movement path of carriage 3 is printing region 8. To the right side of printing region 8, or in other words the right end of the movement path of carriage 3, is a location where printing head 10 performs maintenance and is the home position of carriage 3. On the right side of printing region 8, maintenance unit 4 is set up. Ink tanks 5 (ink cartridges) for four colors, black, cyan, magenta, and yellow, arc disposed in a single line. On the left side of printing region 8, or in other words the left end of movement path of carriage 3, a flushing section (not shown in figure) for forcibly squirting the ink from each nozzle of printing head 10 is set up. In FIG. 2, the flushing section is not shown because carriage 3 is disposed directly above the flushing section.

Cut sheet P, cut into such sizes as A4, letter, legal, or postcard, can be placed in paper-supplying cassette 7. Cut sheet P is stored in position so that the sheet's narrow side extends along a direction (main scanning direction, right-left direction) that perpendicularly crosses a paper sending direction (sub scanning direction, front-back direction). Hereinafter, the dimension of the narrow side will be called the width of cut sheet P, and the long side will be called the length of cut sheet P. A stack of cut sheets P is stored in paper-supplying cassette 7.

As shown in FIG. 3, on the front end section side of paper-supplying cassette 7, paper supporting member 7*a* for supporting a back end section of a long cut sheet P such as a legal-sized sheet is equipped to be movable in the front-back direction. FIG. 3 shows supporting member 7*a* to be disposed in a position protruding outward from main body frame 1 (opening section 1*a*), but when using cut sheet P such as an A4-sized sheet, which fits within paper-supplying cassette body 7*b*, supporting member 7*a* can be stowed within paper-supplying cassette body 7*b*. Then, as shown in FIG. 1, paper-supplying cassette 7 does not protrude outward from main body frame 1.

Figure 5:
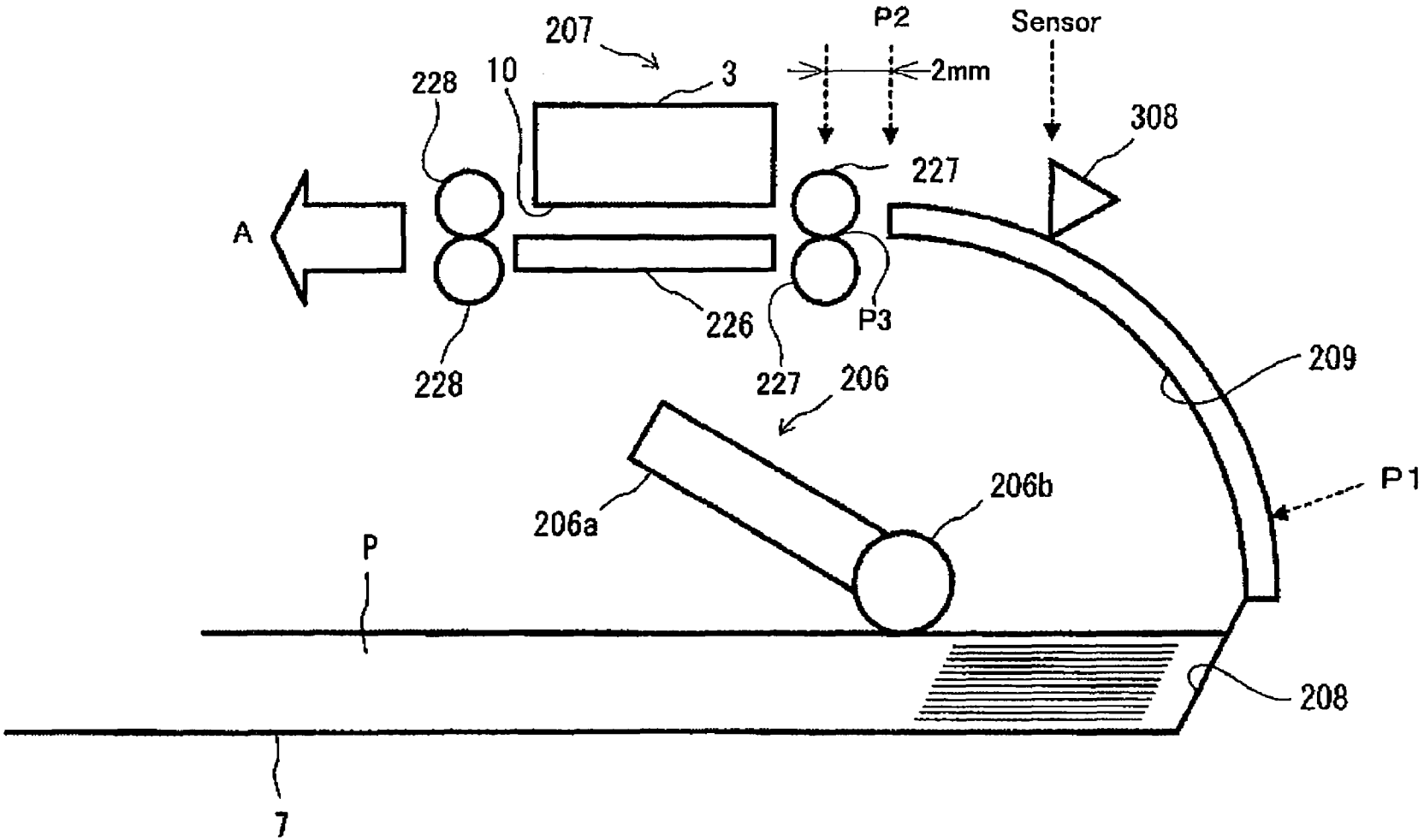
FIG. 5 shows a diagrammatic representation showing a movement path of a cut sheet from a feeder to a printing head of the multifunctional device.

As shown in FIG. 3 and more clearly in FIG. 5, bank section 208 for separating a single cut sheet from the stack of cut sheets P stored in paper-supplying cassette 7 is disposed on the back side (the right side in FIG. 3 and FIG. 5) of paper-supplying cassette 7. Sheet-feeding mechanism 206 is disposed on mainframe 110 made of a box-shaped metallic plate. Sheet-feeding mechanism 206 provides arm 206*a*, and an upper anchor section of arm 206*a* is equipped on mainframe 110 as to enable it to pivot in the up-down direction.

On the bottom end of arm 206*a*, sheet-feeding roller 206*b* is set up. Cut sheet P, positioned at the very top of the stack of cut sheets stored in paper-supplying cassette 7, is pulled out (separated from the stack of cut sheets) and fed towards printing section 207 by sheet-feeding roller 206*b* and bank section 208. Printing section 207 provides carriage 3 loaded with printing head 10 of an inkjet type, and is disposed on the upper section of paper-supplying cassette 7. Cut sheet P, pulled out from paper-supplying cassette 7, is fed towards the rear, then towards the top, and finally towards the front. In other words, it is fed towards printing section 207 through feeding path 209, which is U-shaped.

A pair of sending rollers 227 and a pair of paper discharging rollers 228 are disposed along feeding path 209. Printing section 207 provides carriage 3 and printing head 10, and is disposed between sending rollers 227 and paper discharging rollers 228. Printing head 10 squirts ink downwards. When the cut sheet is positioned below printing head 10, the ink squirted from printing head 10 sticks and is printed on the cut sheet. In other words, the position below printing head 10 is the printing position. The pair of sending rollers 227 sends cut sheet P towards the printing position, and then the pair of paper discharging rollers 228 sends cut sheet P, which was printed at the printing position, from the printing position.

Cut sheet P, printed at the printing position by printing head 10, is discharged on the upper surface of paper-supplying cassette 7 from paper discharging section 210 in a condition where the printing surface faces up. On the upper surface of paper supplying cassette 7, paper-discharging tray 6 for setting the discharged cut sheet P is formed. Paper discharging opening 210*a*, connected to paper discharging section 210, is joined to opening section 1*a* of the front surface of main body frame 1.

As shown in FIG. 3, cover body 230 covers main body frame 1. Cover body 230 covers an opening on an upper side of main body frame 1. Bottom wall 211 of image reading device 2 overlaps with and is disposed on cover body 230. Image reading device 2 is configured to be able to pivot, with respect to main body frame 1, at a rotating axis section not shown in the figure but disposed on the left side of the MFD. Manuscript cover 213 is disposed on an upper surface of image reading device 2. A back end of manuscript cover 213 is attached to a back end of image reading device 2 at rotating axis 212*a*. Manuscript cover 213 is configured to be able to open and close against image reading device 2.

On the upper side of the front of main body frame 1 and in the front of image reading device 2, control panel section 214, providing such features as various control buttons and a liquid crystal display section, is set up and disposed so that ink tank 5, set up on printing section 207 and paper discharging section 210 as well as on a side section of paper discharging section 210, is positioned within the projection area when image reading device 2 and control panel section 213 are viewed from a planar view. In addition, in a condition where supporting member 7*a* on paper-supplying cassette 7 is stowed in paper-supplying cassette main body 7*b*, the length of paper-supplying cassette 7 in the front-back direction is approximately equal to the length of image reading device 2 and control panel section 214 also in the front-back direction. Therefore, since this MFD is a rectangular solid and is approximately a square when viewed from a planar view, it becomes easier to-package and ship it as a product, and a box used for the packaging can be miniaturized.

Mounting glass 216, which can open manuscript cover 213 towards the upper side and mount the manuscript, is equipped on the upper surface of image reading device 2, and below it image scanning device (CIS: Contact Image Sensor) for reading images is set up as to movable in a round-trip fashion along guide shaft 244, which extends in the direction (main scanning direction in FIG. 1, and left-right direction in FIG. 2) perpendicular to a paper surface in FIG. 3.

First tank of the four ink tanks 5 holds black (BK) ink, second tank holds cyan (C) ink, third tank holds magenta (M) ink, and fourth tank holds yellow (Y) ink. The four ink tanks 5 hold four colors for a full color print. Each ink tank provides an approximately rectangular shape long in the height direction, and its area when viewed from a planar view is small. These ink tanks 5 are stowed in a single row along the front-back direction, and is detachable when image reading device 2 is pivotally turned (opened) upwards.

Ink tube 14 is connected to each ink tank 5, and supplies ink from each ink tank 5 to printing head 10. The same number of ink tubes 14 as the number of ink colors (in this case, four) is prepared. When using more than four colors of ink (such as six to eight colors), ink tanks 5 corresponding to the number of ink colors may be configured to be storable, and the number of ink tubes 14 may be increased to mach the number of ink tanks 5.

As described above, a flushing section not shown in the figure is disposed on one end side (in the present embodiment, on the left side of FIG. 1 and FIG. 2), and maintenance unit 4 is disposed on the other end side (right side of FIG. 1 and FIG. 2).

Printing head 10, at the flushing position set up on a flushing section, performs a discharge operation of ink required to prevent the clogging of nozzles.

When carriage 3 moves to a maintenance position, a nozzle cap of maintenance unit 4 covers a nozzle surface of printing head 10 from the bottom direction, selectively absorbs black ink and other colored ink, and implements a recovery process to remove air bubbles within a buffer tank, not shown in the figure, within printing head 10. When carriage 3 moves in the right-left direction near maintenance unit 4 at a predetermined timing, cleaning of a nozzle surface is performed by a wiper, removing extra ink or other extraneous materials on the surface of the nozzle.

Figure 4:
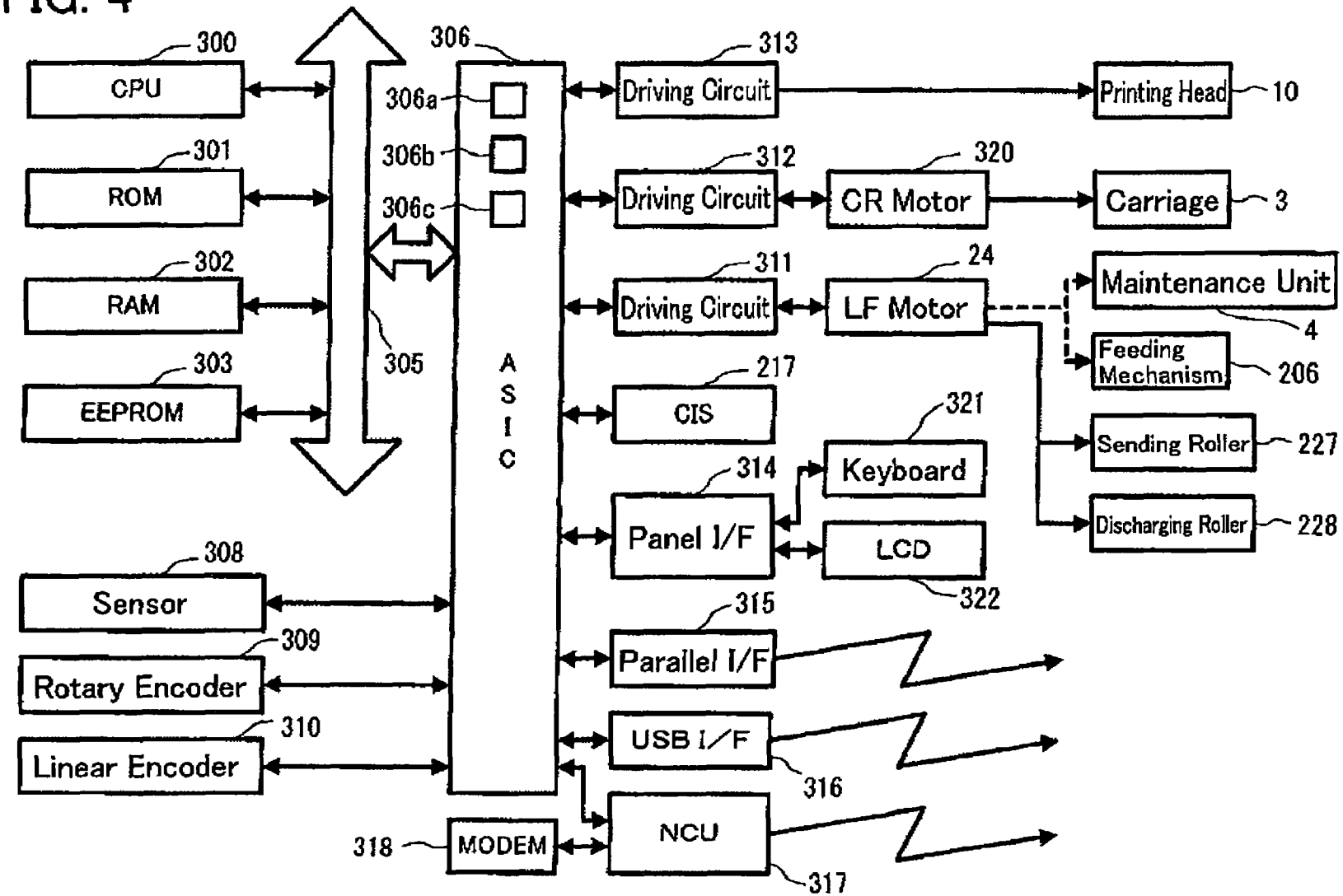
FIG. 4 shows a block diagram showing an electrical configuration of the multifunctional device.

With reference to FIG. 4, a controlling section (controller) of the MFD will be explained. This controlling section controls the overall operations of the MFD.

The controlling section is configured of a microcomputer system with CPU 300, ROM 301, RAM 302, and EEPROM 303 as the central components, and connects to ASIC (Application Specific Integrated Circuit) 306 via bus 305.

In order to send cut sheet P in the sub scanning direction (front-back direction), sending motor (LF motor) 24 for driving pair of sending rollers 227 and pair of paper discharging rollers 228 is provided. Sending rollers 227 and paper discharging rollers 228 are rotated by LF motor 24. By rotating sending rollers 227, cut sheet P is sent along the sub scanning direction (the front-back direction, direction of arrow A in FIG. 3) towards the printing position (the position directly below printing head 10). By rotating paper discharging rollers 228, cut sheet P is sent from the printing position (the position directly below printing head 10) along the sub scanning direction (the front-back direction, direction of arrow A in FIG. 3) towards paper discharging section 210.

In order to control LF motor 24, CPU 300, ASIC 306, and driving circuit 311 arc prepared. CPU 300 orders operation instructions to ASIC 306. ASIC 306 generates control signals according to the operation instructions ordered by CPU 300. Specifically, it generates PWM signals. Driving circuit 311 generates pulse signals according to the PWM signals to apply to LF motor 24.

Programs, or the like, to control various operations of the MFD are stored in ROM 301, and RAM 302 is used as a work area or a temporary storage area to temporarily store various data used while the CPU is running these programs.

NCU (Network Control Unit) 317 is connected to ASIC 306, and a communication signal inputted from a public line to NCU 317 is inputted, after being demodulated by MODEM 318, to ASIC 306. In addition, when ASIC 306 sends an image data to the exterior by methods such as facsimile transmission, that image data is modulated to a communication signal by MODEM 318 and outputted to the public line via NCU 317.

ASIC 306 follows the instructions from CPU 300, for example, generating a phase excitation signal to be applied to LE motor 24 and outputting these signals to driving circuit 311 of sending LF motor 24. In addition, it outputs a driving signal to driving circuit 312 of motor (CR motor) 320, which drives carriage 3, ASIC 306 follows the instructions from CPU 300, and applies the driving signal to components such as LF motor 24 and CR motor 320 via driving circuit 311 or driving circuit 312, and controls such operations as the rotating or stopping of LF motor 24 or CR motor 320.

Connected to ASIC 306 are image reading section 217 (such as CIS or CCD) to read in characters or images of a manuscript supplied by the MFD from a sheet stacker not shown in the figure, and interface 314 to interface with panel section 214, which provides LCD 322 or keyboard 321 for sending and receiving operations. Further, connected to ASIC 306 are parallel interface 315 for sending and receiving data via external devices such as a personal computer and a parallel cable, and USB interface 316 for sending and receiving data via external devices such as a personal computer and a USB cable.

Further, connected to ASIC 306 are sensor 308 provided to detect a position of cut sheet P, rotary encoder 309 set up on sending roller 227 or LF motor 24 for detecting a rotation amount of sending roller 227, and linear encoder 310 set up for detecting a movement amount of carriage 3.

In addition, set up within ASIC 306 are counter 306*a* to take a pulse count of a pulse signal outputted from rotary encoder 309, timer 306*b* to be described hereinafter, or register 306*c* to configure a target position for the leading edge of cut sheet P fed by sheet-feeding mechanism 206. Other devices such as various counters, timers, and registers are also incorporated within ASIC 306, but are not described here because they do not directly relate to the description of the present embodiment.

Driving circuit 311 is used to drive LF motor 24 connected to sending rollers 227. By driving circuit 311 to drive sending rollers 227, cut sheet P is sent in the sub scanning direction (direction of arrow A).

Driving circuit 312 is used to drive CR motor 320 which moves carriage 3, mounting printing head 10, in the main scanning direction. By driving circuit 312 to drive CR motor 320, carriage 3 moves in the main scanning direction (right-left direction) along with the mounted printing head 10.

Driving circuit 313 is used to discharge a predetermined amount of ink from a selected nozzle of printing head 10 to cut sheet P at a predetermined timing. Driving circuit 313 controls the operation of printing head 10 by receiving a signal generated in ASIC 306, wherein the signal is based on a controlling procedure outputted by CPU 300.

Next, a method will be described for matching the position of cut sheet P with a fixed position when cut sheet P begins to be sent by sending rollers 227 towards printing head 10.

As shown in FIG. 5, a stack of cut sheets P is stored in paper-supplying cassette 7. Feeding roller 206*b* of sheet-feeding mechanism 206 contacts an upper surface of cut sheet P positioned at the very top of the stack of cut sheets P. When feeding roller 206*b* is rotated, the single uppermost cut sheet P is separated, by bank section 208, from the other cut sheets P positioned below, and only the single separated cut sheet P is fed along U-turn pass 209 and towards sending rollers 227. When a leading edge of the fed cut sheet P reaches a position to face sensor 308, sensor 308 turns ON. Cut sheet P is fed further and contacts the pair of sending rollers 227 along a line P3 where sending rollers 227 contact. At this time, the pair of sending rollers 227 is either stationary or rotating in reverse. In other words, when the leading edge of cut sheet P contacts the pair of sending rollers 227 along line P3, sending rollers 227 are either stationary or rotating in reverse. Even after the leading edge of cut sheet P contacts sending rollers 227, feeding roller 206*b* continues to feed cut sheet P. As a result, cut sheet P bends, and because cut sheet P tries to return to its original position, the leading edge of cut sheet P tries to move forward towards the left of the figure. Accordingly, the leading edge of cut sheet P becomes aligned along the straight line P3. Even if the leading edge of cut sheet P is not parallel with the straight line P3 between the pair of sending rollers 227, the leading edge of cut sheet P becomes aligned along the straight line P3, and the slanted condition is adjusted.

Figure 6:
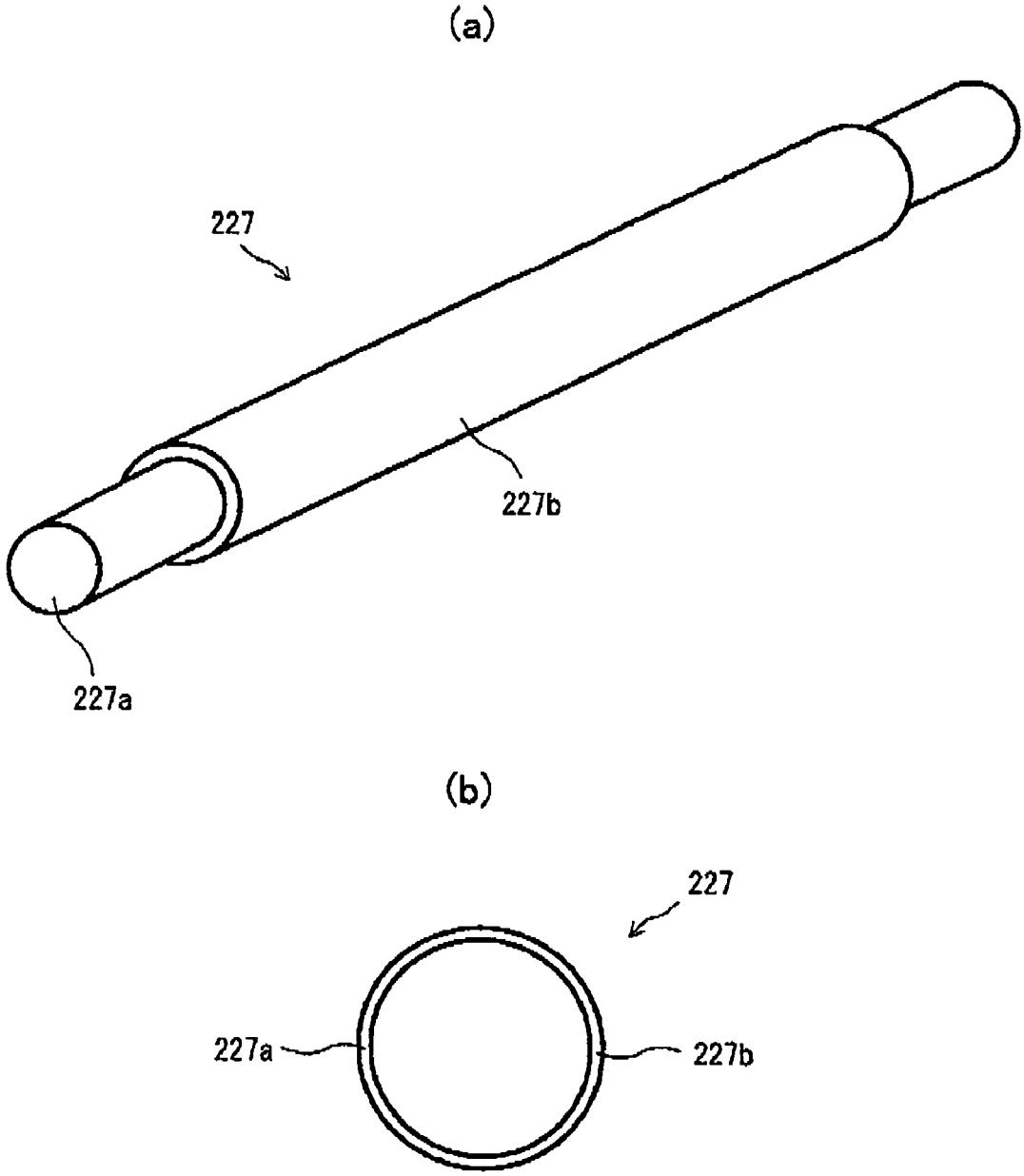
FIG. 6(*a*) shows a perspective diagram emphasizing a construction of a sending roller.

With reference to FIG. 6(*a*) and FIG. 6(*b*), a configuration of sending roller 227 will be described. As shown in FIG. 6, this sending roller 227 is formed on axis 227*a*, which is straight, by applying coating material 227*b* containing ceramic grain. Axis 227*a* is formed from free cutting steel (SUM22L-D) with an outer diameter of 8 mm, and has a nickel plating chemical (MCNi3) applied to its surface. In terms of a method for schematically forming sending roller 227, axis 227*a* is manufactured first. Then, sending roller 227 is formed by having coated it with ceramic coating material 227*b*. Ceramic coating material 227*b* has an approximate film thickness of 34 μm. As can be understood from this description, FIG. 6(*a*) and FIG. 6(*b*) are illustrated with emphasis on the film thickness of ceramic coating material 227*b* on the outer diameter of axis 227*a*, in order to understand the construction of sending roller 227 more easily.

Since the surface of free cutting steel 227*a* is glazed with ceramic coating 227*b*, the strength of fiction of sending roller 227 on cut sheet P is very strong. For an inkjet type printer that alternately repeats the sending, halting, and printing movements, it is effective to use sending roller 227 with high friction. However, by using sending roller 227 with high friction, the following problems could arise. Specifically, when aligning the leading edge of cut sheet P along line P3 between sending rollers 227 before sending cut sheet P to printing section 207, the leading edge of cut sheet P that is in contact with sending rollers 227 could peel off and be damaged. Especially if cut sheet P is a coating paper such as glazed paper, the coating could come off at the leading edge of cut sheet P.

Figure 7:
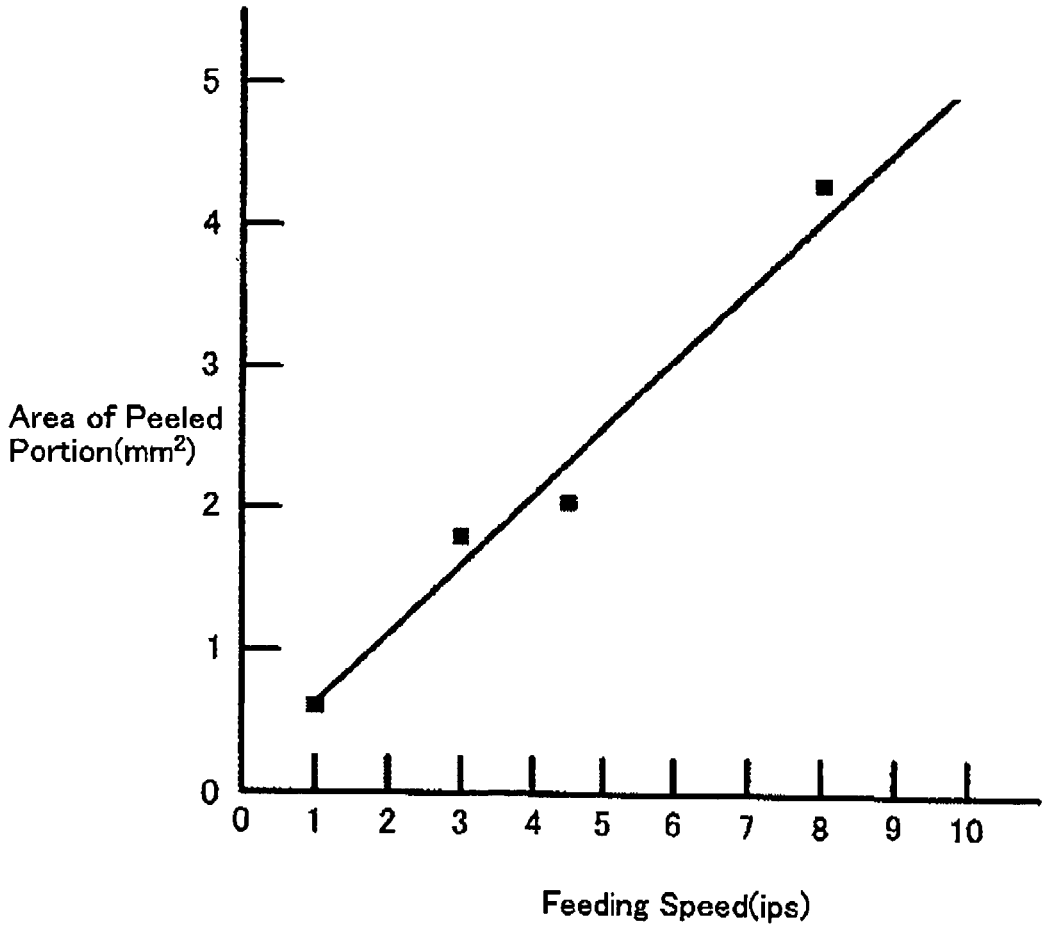
FIG. 7(*a*) shows a graph showing a relationship between a feeding speed when a leading edge of a cut sheet contacts the pair of sending rollers and an area where peeling has occurred on the leading edge of the cut sheet.

FIG. 7(*a*) and FIG. 7(*b*) show a graph and chart representing the results that measured a relationship of a feeding speed of the leading edge of cut sheet P when it contacts sending rollers 227 and peeled area of the leading edge of cut sheet P. As is obvious from the graph, whereas the peeled area is small if the feeding speed of the leading edge of cut sheet P when it contacts sending rollers 227 is low, and the peeled area is large if the feeding speed of the leading edge of cut sheet P when it contacts sending rollers 227 is high.

In order to prevent the coating at the leading edge of cut sheet P from peeling, it is desirable to decrease the feeding speed when the leading edge of cut sheet P contacts sending rollers 227. However, if the feeding speed is too low, a long time will be required for sending cut sheet P. In addition, if the feeding speed is too low when the leading edge of the cut sheet contacts sending rollers 227, the slant-adjusting phenomenon cannot be obtained.

In the present embodiment, when there is a strong need to prevent the coating from peeling off at the leading edge of cut sheet P, the leading edge of cut sheet P is set to contact sending rollers 227 after the feeding speed of cut sheet P has been reduced. Specifically, the leading edge of cut sheet P is set to contact sending rollers 227 after the feeding speed has been reduced to 4.5 inches/second. As can be understood from the experiment results of FIG. 7, there is no significant difference in the peeled area between feeding speeds of 3 inches/second and 4.5 inches/second. If the feeding speed is 4.5 inches/second, the slant-adjusting capability for a cut sheet with a small width can be maintained. Further, if the feeding speed is 4.5 inches/second, the time required to send cut sheet P is held within an acceptable range.

Figure 8:
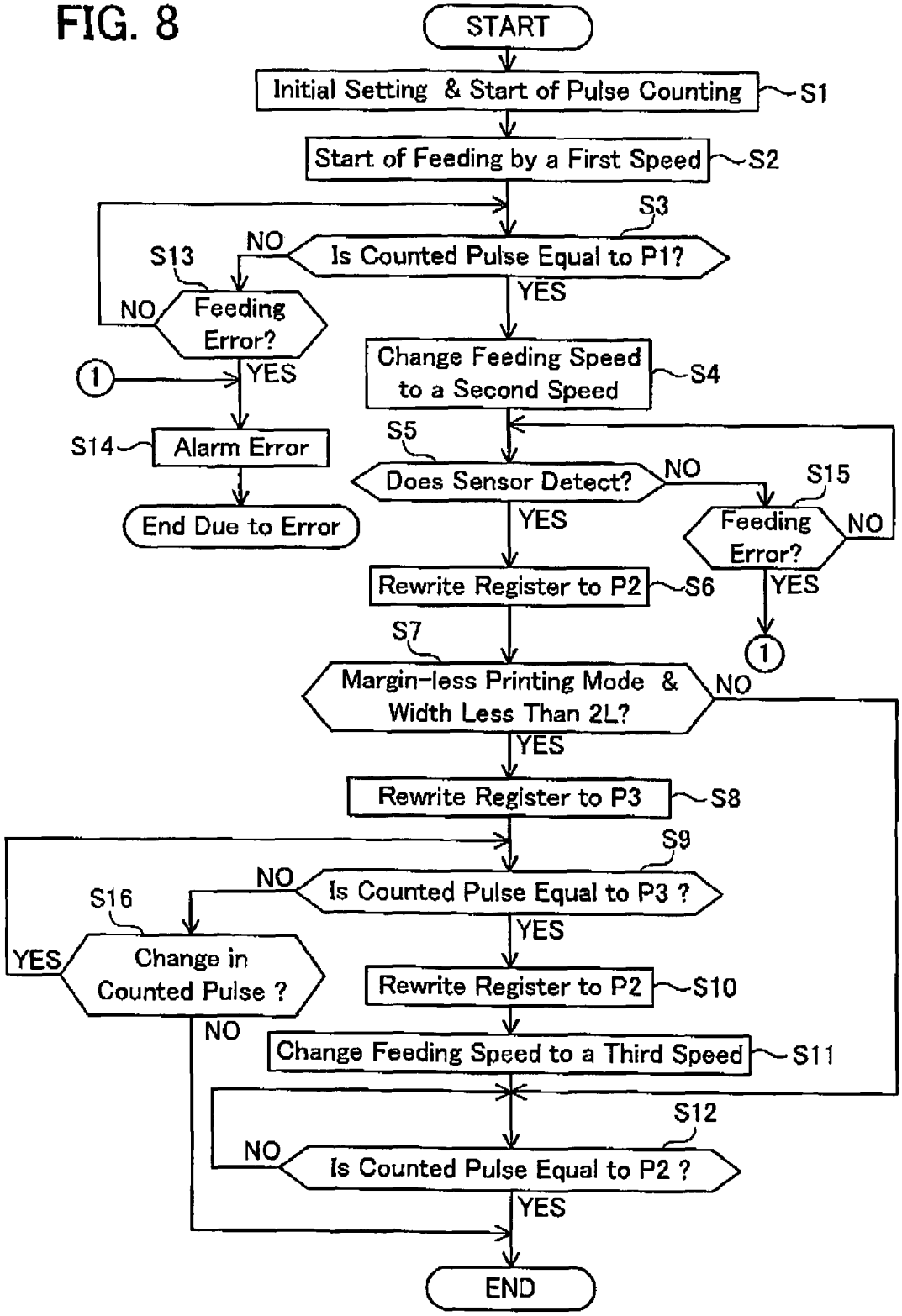
FIG. 8 shows a flowchart showing a procedure of controlling a printer.

Next, with reference to FIG. 8, a controlling method of the MFD of the present embodiment will be described. FIG. 8 shows a flowchart of the controlling method of the MFD of the present embodiment.

A user instructs various orders, including a printing mode to be performed by the MFD, from a PC connected via parallel I/F315 or USBI/F316, or from control panel section 214. For an instruction that includes printing operation, a printing mode is specified to determine whether the printing will be a so-called margin-less printing, which does not leave a margin along the leading edge of cut sheet P, or a so-called margined printing, which leaves a margin along the leading edge of cut sheet P. Further, information such as the size of cut sheet P is also inputted. Then, after the printing mode and the size of cut sheet P, or any other relevant settings, have been determined, the user orders the MED to implement the process that includes printing operation. In the margin-less printing mode, printing operation is stated when the leading edge is sent to the printing position. Print start position is on the leading edge. There is no margin along the leading edge of cut sheet P. Depending on a picture to be printed on cut sheet P, left, right and/or bottom margin(s) may be left in the margin-less printing mode. When a left margin is left, the margin is observed at a corner between the left edge and the leading edge of cut sheet P in the margin-less printing mode. When a right margin is left, the margin is observed at a corner between the right edge and the leading edge of cut sheet P in the margin-less printing mode. As long as there is no margin between the leading edge of cut sheet P and the leading edge of the printed picture, that printing style may be described that there is no margin along the leading edge of cut sheet P, even if a margin may be observed at left and/or right distal end(s) of the leading edge of cut sheet P. The margin-less printing mode may allow corner margin(s) at left and/or right distal end(s) of the leading edge of cut sheet P. Typically, no margin may be observed along four edges of cut sheet P when the margin-less printing mode is selected.

When instructions by the user are-inputted, a controlling section having CPU 300 as its core executes the flowchart shown in FIG. 8 in order to operate the MFD according to the inputted instructions.

First, while initial settings are implemented, counter 306*a* begins taking the pulses count of a pulse signal outputted from rotary encoder 309 (step 1: hereinafter, abbreviated as S1. Other steps will follow similar abbreviations).

These initial settings include the following settings. Specifically, counter 306*a* and timer 306*b* within ASIC 306 are cleared to zero, and stored in register 306*c* is the pulse count (first pulse count) of rotary encoder 309 necessary for the leading edge of cut sheet P fed by sheet-feeding mechanism 206 to reach a first position (P1, shown in FIG. 5), which is a predetermined distance downward from bank section 208 towards U-turn pass 209.

Next, ASIC 306 drives LF motor 24 at a first speed (3 inches/second in the present embodiment) via driving circuit 311. Accordingly, sheet-feeding section 206 begins to feed the uppermost cut sheet P at the first speed (S2), from a stack of cut sheets mounted within paper supplying cassette 7. The reason cut sheet P begins to be fed at the first speed (3 inches/second in the present embodiment) which is slower than a second speed (8 inches/second in the present embodiment) to be described below is because the coefficient of static friction of cut sheet P is larger than the coefficient of kinetic friction. A stronger sending force is required when separating and feeding the single cut sheet P from the stack of cut sheets P.

The pulse count that counter 306*a* is counting is constantly compared to the first pulse count stored within register 306*c*, and whether or not the pulse count that counter 306*a* is counting has reached the first pulse count is determined in S3. During the time that the pulse count of counter 306*a* has not yet reached the first pulse count (S3: No), whether or not feeding roller 206*b* of sheet-feeding mechanism 206 is rotating is being determined. In other words, whether or not a feeding error has occurred (S13) is being determined. Specifically, this is determined as described below. Timer 306*b* within ASIC 306 keeps track of the time between the pulse intervals of the pulse signal inputted from rotary encoder 309. In other words, each time a single pulse from rotary encoder 309 is inputted, timer 306*b* is cleared to zero and begins measuring the amount of time until the next pulse is inputted. The proper time interval of the pulses for when the cut sheet is being fed is known in advance, so S13 compares a predetermined threshold value, which is somewhat longer than the time interval of the pulses, to the amount of time until the next pulse is inputted. When the amount of time until the next pulse is inputted becomes greater than the predetermined threshold value, S13 determines that feeding roller 206*b* is stationary, or in other words, that a feeding error has occurred. If it is determined that a feeding error has occurred (S13: Yes), S13 reports the error to the user (S14) via LCD 322 or speakers not shown in the figure, and this flow terminates due to the generated error. If it is determined that there is no feeding error (S13: No), then this flow is implemented again from the process of S3.

If cut sheet P is being fed properly, the pulse count of counter 306*a* becomes equal to the first pulse count when the leading edge of cut sheet P is fed to position P1 of FIG. 5, and S3 becomes Yes. Then, ASIC 306 increases the rotation speed of LF motor 24, via driving circuit 311, from the first speed (3 inches/second in the present embodiment) to the second speed (8 inches/second in the present embodiment). That the pulse count of counter 306*a* has reached the first pulse count means that feeding roller 206*b* rotated properly, so it can be assumed that the single cut sheet P had been separated and fed. Afterwards, in order to feed cut sheet P more quickly, the feeding speed of cut sheet P increases from the first speed (3 inches/second in the present embodiment) to the second speed (8 inches/second in the present embodiment).

Next, whether or not the leading edge of cut sheet P has been detected by sensor 308, or whether or not sensor 308 is turned ON, is determined (S5). During the time sensor 308 is not turned ON (S5: No), similarly to S13, whether or not feeding roller 206*b* of sheet-feeding mechanism 206 is rotating, or whether or not a feeding error has occurred (S15), is being determined. When it is determined that a feeding error has occurred (S15: Yes), S15 reports the error to the user (S14) via LCD 322 or speakers not shown in the figure, and this flow terminates due to the generated error. If it is determined that there is no feeding error (S15: No), then this flow is implemented again from a process of S5.

If cut sheet P is being fed properly, when the leading edge of cut sheet P is fed to a position to face sensor 308, sensor 308 is turned ON. If it is determined that sensor 308 has been turned ON (S5: Yes), a pulse count (a second pulse count) is restored in register 306*c* (S6), wherein that pulse count (the second pulse count) is a total pulse count of a pulse count corresponding to 12 mm+$\alpha$(wherein $\alpha$ is approximately 3 mm in this case) added to the pulse count counted by counter 306*a* within ASIC 306. In the MFD of the present embodiment, the distance between sensor 308 and contacting line P3 of sending rollers 227 is 12 mm. The α is an additional sending amount for further feeding and bending cut sheet P after the leading edge of cut sheet P has bit sending rollers 227. The second pulse count is the pulse count until a process has been completed to align the leading edge of cut sheet P along straight contacting line P3 between the pair of sending rollers 227.

Next, a printing mode to be performed and a size of cut sheet P are determined (S7). As described above, these are determined according to instructions inputted by the user in advance from a PC connected to parallel I/F315 or USB I/F316, or from a control panel section 214.

If it is determined that the printing mode to be performed on the cut sheet is a margin-less printing mode and that the dimension (width) of cut sheet P is less than 2 L (127 mm) in the direction perpendicular to the sending direction (S7: Yes), the second pulse count stored in register 306*c* within ASIC 306 is overwritten by a third pulse count (S8). The third pulse count is a total pulse count of a pulse count corresponding to 10 mm added to the pulse count stored in counter 306*a* when sensor 308 was turned ON. The third pulse count is smaller than the second pulse count. The third pulse count is a pulse count that corresponds to a position 10 mm downward from sensor 308, in the direction towards sending rollers 227 (P2, referred in FIG. 2), wherein position P2 is the position 2 mm upstream from sending rollers 227.

At this time, if the printing mode to be performed on cut sheet P is the margin-less mode and if the width of cut sheet P is less than 2 L, whether or not the pulse count of counter 306*a* has reached the third pulse count is determined (S9). During the time the pulse count of counter 306*a* has not yet reached the third pulse count (S9: No), whether or not feeding roller 206*b* of sheet-feeding mechanism 206 is rotating, or in other words, whether or not the count number of counter 306*a* is changing (S16), is determined.

As described above, timer 306*b* within ASIC 306 keeps track of the time between the pulse intervals of the pulse signal inputted from rotary encoder 309. In other words, each time a single pulse from rotary encoder 309 is inputted, timer 306*b* is cleared to zero and begins measuring the amount of time it takes until the next pulse is inputted. The proper time interval of the pulses for when the cut sheet is being sent is known in advance, so similarly to S13, S16 compares a predetermined threshold value, which is somewhat longer than the time interval of the pulses, to the amount of time until the next pulse is inputted. When the amount of time until the next pulse is inputted becomes greater than the predetermined threshold value, S16 determines that feeding roller 206*b* is stationary, or in other words, that the count number of counter 306*a* is not changing. If it is determined that the count number of counter 306*a* is not changing (S16: No), the flow terminates. This is because, as obvious from the fact that sensor 308 has already been turned on at S5, the printing process for cut sheet P can be continued because the feeding process of cut sheet P has been completed. This is because a sensor to detect the leading edge of the cut sheet, other than sensor 308, is also set up within printing section 207, and the necessary error process can be implemented when these sensors detect an error.

If cut sheet P is being fed properly, the pulse count of counter 306*a* becomes equal to the third pulse count (S9: Yes) when the leading edge of cut sheet P is fed to position P2, 2 mm upstream of sending rollers 227. At this time, the third pulse count stored in register 306*c* within ASIC 306*a* is, again, overwritten (S10) by the second pulse count described above. It is set back to the second pulse count, which was written in S6. Further, ASIC 306 reduces the speed of LF motor 24 (S11), via driving circuit 311, from the second speed (8 inches/second in the present embodiment) to the third speed (4.5 inches/second in the present embodiment). The reason for this is because, as described above, if coating paper such as glazed paper contacts sending rollers 227 with the fast pace of the second feeding speed rather than the slow feeding third speed, the coating on the leading edge of cut sheet P gets peeled off, damaging cut sheet P and decreasing the quality of printing. If the leading edge of cut sheet P contacts sending rollers 227 after the feeding speed has been reduced to the third speed (4.5 inches/second in the present embodiment), the area of the coating of the leading edge of cut sheet P that gets peeled off is small, and the decline in printing quality can be avoided.

Finally, whether or not the pulse count counted by counter 306*a* has reached the second pulse count (S12) is determined. S12 is repeated during the time it is being determined that the pulse count of counter 306*a* has not reached the second pulse count (S12: No), and this flow terminates when the pulse count of counter 306*a* has reached the second pulse count (S12: Yes).

At the time the pulse count of counter 306*a* has reached the second pulse count, the leading edge of cut sheet P is fed further for an additional sending amount (α) after the leading edge of cut sheet P has hit contact line P3 between the pair of sending rollers 227. Cut sheet P is being bent. By cut sheet P trying to return to its original shape, the leading edge of cut sheet P becomes aligned along straight line P3 that contacts the pair of sending rollers 227. At the stage when the process of FIG. 8 is complete, the leading edge of cut sheet P has been aligned with straight line P3 contacting the pair of sending rollers 227.

After completing the process of FIG. 8, sending rollers 227 begin to rotate in the forward direction, and begin to send cut sheet P towards the printing position. Then, printing head 10 begins the printing operation. The time difference between the timing that sending rollers 227 begin its forward rotation and the timing that printing head 10 begins its printing operation is determined by the width of the margin along the leading edge of the cut sheet. If margin-less printing mode is set, printing head 10 begins the printing operation at a timing when the leading edge of the cut sheet sent by sending rollers 227 reaches the printing position. For example, if the width of the margin of the leading edge of the cut sheet has a width of 10 mm, printing head 10 begins the printing operation at a timing when the leading edge of the cut sheet sent by sending rollers 227 has passed through the printing position for a distance of 10 mm. Since the position of the cut sheet is controlled to be fixed when cut sheet P begins to be sent towards the printing position, by controlling the timing of when sending rollers 227 begin its forward rotation and the timing of when the printing operation begins with printing head 10, a print start position on the cut sheet with respect to the leading edge of cut sheet P can be controlled to a desired position.

In FIG. 5, when compared to the first position (P1), approximately 30 mm downward from bank section 208 towards U-turn pass 209, the distance from sensor 308 to contact line P3 between the pair of rollers 227 (12 mm) or the distance from sensor 308 to the second position (P2) (10 mm) are exaggerated and illustrated to be longer than they are. The reason for this is to make the positional relationship between sensor 308 and the second position (P2) and the positional relationship between sensor 308 and the position of the sending rollers (P3) easier to understand.

The present embodiment, depending on a condition (depending on a distinction result of distinction process S7), either performs (if performing process 11) or does not perform (if not performing process 11) the process to reduce the feeding speed of cut sheet P from the second speed to the third speed, immediately before sending rollers 227. When margin-less printing mode is selected and the paper width of cut sheet P is less than 2 L, the present embodiment performs a deceleration process. If that condition is not satisfied, the deceleration process is omitted.

If margin-less printing mode is assigned and if undesired effects such as peeling occur at the leading edge of cut sheet P due to sending rollers 227, a part of the image at the damaged portion of the leading edge is lost since printing is performed along the leading edge of cut sheet P. The printing quality consequently declines. For this situation, damaging the leading edge of cut sheet P is prevented by performing the deceleration process of process S11.

In addition, if the paper width of cut sheet P is less than 2 L (127 mm) and if undesired effects such as peeling occur at the leading edge of cut sheet P due to sending rollers 227, the quality of the printed image declines since specially coated paper such as glazed paper for picture images or paper exclusively for inkjet printers are generally used. For this situation, damaging the leading edge of cut sheet P is prevented by performing the deceleration process of process S11.

In the MFD of the present embodiment, the slant-adjusting capability of cut sheet P decreases if the feeding speed of cut sheet P with a paper width greater than 2 L has decreased from the second speed to the third speed. On the other hand, if cut sheet P has a paper width less than 2 L, the slant-adjusting capability of cut sheet P does not decrease even if the feeding speed of cut sheet P has decreased from the second speed to the third speed. Printing on a slanted cut sheet P can be avoided if the feeding speed of cut sheet P is reduced to the third speed immediately before sending rollers 227, as long as the paper width of cut sheet P is less than the predetermined dimension.

In the present embodiment, the two conditions described above are AND conditions. A user generally performs margin-less printing on a specialized sheet of a photograph size or a postcard exclusively developed for inkjet printers, for example, when printing data from such devices as a digital camera. Ordinarily, if implementing margin-less printing, the AND condition is satisfied because both conditions described above are satisfied.

Since the AND condition is adopted, for example, if performing margin-less printing on an A4 size cut sheet, the process to decrease the feeding speed of cut sheet P immediately before sending rollers 227 from the second speed to the third speed is omitted, but for large cut sheet such as an A4-size cut sheet, since it is larger compared to other cut sheets smaller than 2 L, any peeling at the leading edge will be inconspicuous. There is a more urgent need to prevent the slant-adjusting capability from decreasing.

The present invention is not limited to the example of the embodiment described above, and various modifications are possible within a range that does not deviate from the aim of the present invention.

For example, the condition of decreasing the feeding speed of cut sheet P, immediately before sending rollers 227, from the second speed to the third speed may be used when margin-less printing mode is selected. Alternatively, it can be used when the paper width of cut sheet P is less than 2 L (127 mm). Alternatively, the sending speed of cut sheet P can be decreased immediately before sending rollers 227 if at least one of the two conditions is met. In other words, S7 of FIG. 8 can be modified to either "margin-less printing mode?", "paper width less than 2 L?", and "margin-less printing mode or paper width less than 2 L?"

In addition, conditions of the present embodiment such as the first, second, and third speeds, positions P1 and P2, or the paper width such that cut sheet P, perpendicular to a paper sending direction, is less than 2 L (127 mm) are not limited to the speeds, positions, or widths described above, and the different conditions can be determined to suit different devices depending on the size of the device, the feeding roller, the sending rollers, surface material, or other specifications. Position P2, where the feeding speed of cut sheet P decreases, is positioned 10 mm downstream of sensor 308, but sensor 308 may be set at position P2.

As described above, according to the present invention, if the predetermined condition is satisfied, when matching the position of the leading edge of the cut sheet by aligning the cut sheet with the sending rollers, a high quality printing image can be obtained because the feeding speed can be reduced so that the leading edge of the cut sheet does not get damaged by the sending rollers.

In addition, if margin-less printing mode to print an image on the entire surface of the cut sheet is set, a high quality printing image can be obtained without the edge portion being damaged, which is particularly noticeable for margin-less printing, because the feeding speed can be reduced so that the leading edge of the cut sheet does not get damaged by the sending rollers.

In addition, the necessary slant adjustment capability can be maintained because the feeding speed is reduced exclusively for cut sheets with paper widths less than the predetermined dimension.

In addition, by selecting the condition of whether or not to reduce the feeding speed, a high quality printing image can be obtained without the edge portion being damaged, which is particularly noticeable for margin-less printing, while simultaneously preventing the slant-adjusting capability of the cut sheet from decreasing.

In addition, if the predetermined condition does not apply, the printing operation does not unnecessarily slow down because the feeding speed of the cut sheet does not decrease before the leading edge of the cut sheet contacts the sending rollers.

What is claimed is:

1. A printer comprising:

a feeder for feeding a cut sheet from a stack of cut sheets;

a roller for sending the cut sheet fed from the feeder to a printing position;

a printing head for printing on the cut sheet at the printing position;

a sensor provided between the feeder and the roller for detecting a leading edge of the cut sheet being fed towards the roller; and a speed controller for lowering a feeding speed of the feeder based on when the sensor detects the leading edge of the cut sheet, if a predetermined condition is satisfied, and for maintaining the feeding speed of the feeder if the predetermined condition is not satisfied.

2. A printer of claim 1, wherein the predetermined condition is satisfied if a margin-less printing mode is selected in which the printing is performed on the cut sheet without leaving a margin along the leading edge of the cut sheet.

3. A printer of claim 1, wherein the predetermined condition is satisfied if a cut sheet having a width less than a predetermined width is being fed to the roller, the width of the cut sheet being a length of the cut sheet along a direction perpendicular to a feeding direction of the cut sheet.

4. A printer of claim 1, wherein the predetermined condition is satisfied if a margin-less printing mode is selected in which the printing is performed on the cut sheet without leaving a margin along the leading edge of the cut sheet, and a cut sheet having a width less than a predetermined width is being fed to the roller, the width of the cut sheet being a length of the cut sheet along a direction perpendicular to a feeding direction of the cut sheet.

5. A printer of claim 1, wherein the predetermined condition is based on the cut sheet being of a predetermined size.

6. A method of controlling a printer comprising a feeder for feeding a cut sheet from a stack of cut sheets, a roller for sending the cut sheet fed from the feeder to a printing position, and a printing head for printing on the cut sheet at the printing position, the method comprising:

detecting when the cut sheet is fed to a position where a leading edge of the cut sheet is located at a predetermined position that is upstream from the roller; and lowering a feeding speed of the feeder based on the detecting if a predetermined condition is satisfied, and maintaining the feeding speed of the feeder if the predetermined condition is not satisfied.

7. A method of claim 6, wherein the predetermined condition is satisfied if a margin-less printing mode is selected in which the printing is performed on the cut sheet without leaving a margin along the leading edge of the cut sheet.

8. A method of claim 6, wherein the predetermined condition is satisfied if a cut sheet having a width less than a predetermined width is being fed to the roller, the width of the cut sheet being a length of the cut sheet along a direction perpendicular to a feeding direction of the cut sheet.

9. A method of claim 6, wherein the predetermined condition is satisfied if a margin-less printing mode is selected in which the printing is performed on the cut sheet without leaving a margin along the leading edge of the cut sheet, and a cut sheet having a width less than a predetermined width is being fed to the roller, the width of the cut sheet being a length of the cut sheet along a direction perpendicular to a feeding direction of the cut sheet.

10. A method of claim 6, further including not lowering the feeding speed of the feeder based on the detecting if the predetermined condition is not satisfied.

11. A method of claim 6, wherein the predetermined condition is based on the cut sheet being of a predetermined size.

12. An image forming device comprising:

a feeder configured to feed a sheet from a plurality of stacked sheets;

a roller configured to transfer the sheet from the feeder to an image forming position;

an image forming element configured to form an image on the sheet at the image forming position;

a sensor provided between the feeder and the roller and configured to detect a leading edge of the sheet being fed from the feeder towards the roller; and a speed controller configured to reduce a feeding speed of the feeder based on when the sensor detects the leading edge of the sheet if a predetermined condition is satisfied, and configured to maintain the feeding speed of the feeder if the predetermined is not satisfied.

13. The image forming device of claim 12, wherein the predetermined condition is based on the cut sheet being of a predetermined size.

14. The image forming device of claim 12, wherein the predetermined condition is satisfied if a margin-less image forming mode is selected in which image forming is performed without leaving a margin along the leading edge of the sheet.

15. The image forming device of claim 12, wherein the predetermined condition is satisfied if a sheet having a width less than a predetermined width is being fed to the roller, the width of the sheet being a length of the sheet along a direction perpendicular to a feeding direction of the sheet.

16. The image forming device of claim 12, wherein the predetermined condition is satisfied if a margin-less image forming mode is selected in which image forming is performed without leaving a margin along the leading edge of the sheet, and a sheet having a width less than a predetermined width is being fed to the roller, the width of the sheet being a length of the sheet along a direction perpendicular to a feeding direction of the sheet.

* * * * *